United States Patent [19]

DiGiambattista

[11] Patent Number: 4,632,702

[45] Date of Patent: Dec. 30, 1986

[54] MANUFACTURE AND CONSOLIDATION OF ALLOY METAL POWDER BILLETS

[75] Inventor: Vincent N. DiGiambattista, Pittsburgh, Pa.

[73] Assignee: Worl-Tech Limited, Pittsburgh, Pa.

[21] Appl. No.: 849,794

[22] Filed: Apr. 9, 1986

Related U.S. Application Data

[63] Continuation of Ser. No. 787,686, Oct. 15, 1985, and a continuation-in-part of Ser. No. 428,280, Sep. 29, 1982, abandoned.

[51] Int. Cl.[4] ..... G22F 1/00

[52] U.S. Cl. ..... 75/228; 72/272; 75/246; 419/28; 419/31; 419/38; 419/48; 419/53; 419/66; 419/67

[58] Field of Search ..... 419/28, 31, 48, 38, 419/53, 66, 67; 75/228, 246; 72/272

[56] References Cited

U.S. PATENT DOCUMENTS

| | | | |
|---|---|---|---|
| 2,955,709 | 10/1960 | Sejournet | 207/10 |
| 3,010,196 | 11/1961 | Smith et al. | 29/420.5 |
| 3,871,200 | 3/1975 | Onoda et al. | 419/48 |
| 3,899,821 | 8/1975 | Ito et al. | 419/48 |
| 4,040,162 | 8/1977 | Isogai et al. | 419/48 |
| 4,050,143 | 9/1977 | Aslund | 419/48 |
| 4,104,061 | 8/1978 | Roberts | 419/29 |
| 4,131,461 | 12/1978 | DePierre et al. | 75/208 |
| 4,155,776 | 5/1979 | Romer | 136/217 |
| 4,388,054 | 6/1983 | Larsson | 419/48 |

*Primary Examiner*—Stephen J. Lechert, Jr.
*Attorney, Agent, or Firm*—Buell, Ziesenheim, Beck & Alstadt

[57] ABSTRACT

Metal powder of the desired composition having a particle size of −80 mesh is charged into an extrusion container, preferably a piece of carbon steel pipe, in successive layers about two inches thick. Each layer is compacted after deposition by a high energy rate forming ram so as to raise the tap density of the powder to about 80% of theoretical. An inner cover plate is then placed loosely on the compacted powder in the extrusion container, and is not attached to the container shell. On top of this inner plate is placed an outer cover plate which is welded to the container shell. Both plates are also of carbon steel, but are much thicker than the container wall. The container so prepared is heated in a heating furnace to a temperature below the melting temperature of the container and the powder alloy thus raising the density of the powder to about 90–93% of theoretical. The heated container is rapidly transferred to an extrusion press and hot extruded at a reduction ratio of about 3 to 1 and at a pressure of about 3000 tons. The inner cover plate, not being affixed to the extrusion container, does not move at the same rate as the container, and in effect is partially extruded against the powder, so as to raise its density to substantially 100% of theoretical.

A billet having a diameter equal to that of the extrusion container and a density of substantially 100% of theoretical may be produced by loading the container and processing it in the way above set out but extruding it a distance only sufficient to accommodate the inner and outer covers in their extruded condition. The container is then removed without the remainder going through the die.

13 Claims, 10 Drawing Figures

MANUFACTURE AND CONSOLIDATION OF ALLOY METAL POWDER BILLETS

This application is a continuation of application Ser. No. 787,686 filed Oct. 15, 1985 and this application is a coninuation-in-part of my application Ser. No. 428,280, filed Sept. 29, 1982 now abandoned for MANUFACTURE AND CONSOLIDATION OF ALLOY METAL POWDER BILLETS.

This invention relates to the production of billets from alloy metal powder. It is more particularly concerned with methods of manufacture by extrusion of such billets having densities approximating 100% of theoretical densities but employing reduction ratios considerably less than those heretofore employed, thus permitting manufacture of extrusions of relatively large cross-section.

PRIOR ART

It is known to produce metal billets from finely divided metal powders by filling an extrusion container with metal powder, sealing the container, and in some cases evacuating it, heating it to a suitable temperature below the melting point of the powder, and extruding the container and powder through a die. In order to obtain a density in the extruded product approximately 100% of theoretical density, very high pressures are required, and those pressures are obtained from available extrusion presses by employing a reduction ratio as high as 12 to 1. The products so obtained are thus of limited cross-section.

SUMMARY OF THE INVENTION

In my process to be described hereinafter I charge metal particles of the desired composition having a particle size of −80 mesh into an extrusion container, preferably a piece of carbon steel pipe. I prefer to use metal powder atomized by inert gas and cooled from its liquidus temperature to about 425° C. in less than one-tenth of a second. The powder is loaded in successive level layers of about two inches thick, and a high energy rate forming ram is applied to each layer after it is deposited, thus compacting the powder to a tap density of about 80% of theroetical. An inner plate is then loosely placed on the compacted powder in the extrusion container. This plate is also of carbon steel, of perhaps three inches thickness, and is not attached to the container shell. On top of this inner plate is placed a cover plate of the same metal and thickness as the inner plate, and the cover plate is welded to the container shell. The container so prepared is heated in a furnace to a temperature below the melting point of the alloy. For tool steel, that temperature is from about 1400° to about 1900° F. For high temperature alloys, such as are used in aircraft engines, the range extends to about 2100° F. This treatment raises the density of the powder in the container to about 90–93% of theoretical. The heated container is quickly placed in an extrusion press, and the extrusion is made at a reduction ratio of about 3 to 1, and at a force of about 3000 tons. The inner plate, not being affixed to the extrusion container, does not move at the same rate as the container, and in effect is partially extruded against the powder, so as to raise the density of the extruded billet to substantially 100% of theoretical density.

My process may also be adapted to produce an extrusion having a diameter as large as the extrusion container by loading the container and processing it in the way above set out and extruding it a distance sufficient only to accommodate the inner and outer covers in their extruded condition. The container is then removed without the remainder going through the die and thus leaves a billet having the cross-section of the container and the density of an extruded section.

BRIEF DESCRIPTION OF DRAWINGS

My invention will be described hereinafter in connection with the accompanying figures, in which.

DESCRIPTION OF PREFERRED EMBODIMENT

My process is well adapted to the production of billets and shapes of tool steel or other high alloy steels. My starting material is metal powder of the desired composition, most easily obtained by mixing together metal powders of the desired elements in the desired proportions. I use metal powders of −80 mesh, that is, all the powder passes through an 80 mesh screen. I prefer to employ metal powders atomized by inert gas and cooled frofm the liquidus temperature to approximately 425° C. very rapdily, in less than 1/10 of a second. A process which can be adapted to produce such powder is disclosed in Clark et al., U.S. Pat. No. 4,272,463 of June 9, 1981.

Figure 1:
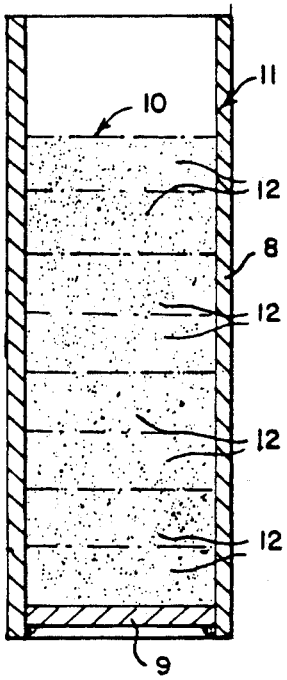
FIG. 1 is a cross-section of an extrusion container loaded with metal powder in layers.
Figure 2:
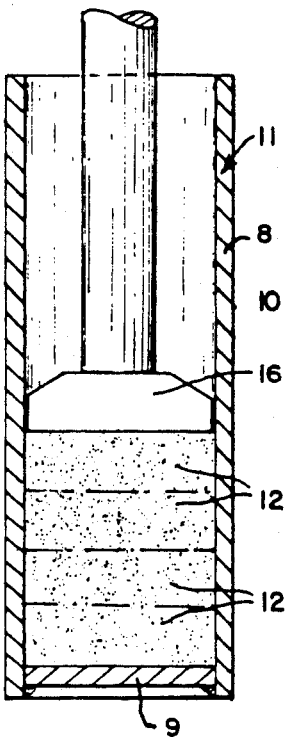
FIG. 2 is a cross-section of an extrusion container with a high energy forming rate ram in position to compact the metal powder.
Figure 3:
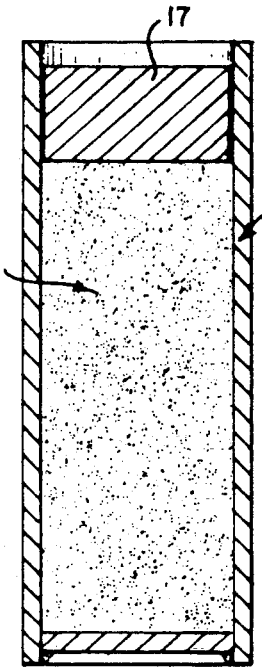
FIG. 3 is a cross-section of an extrusion container loaded with compacted metal powder and having its inner cover plate in place.
Figure 4:
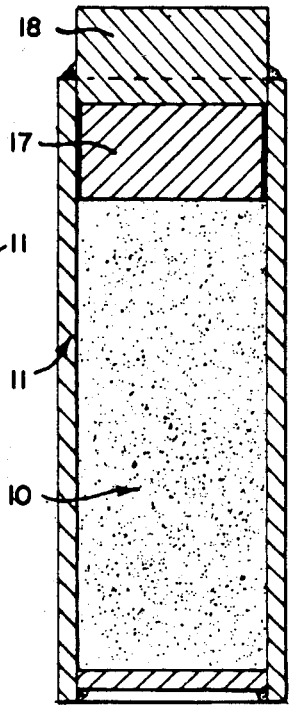
FIG. 4 is a cross-section of the extrusion container of FIG. 3 with its outer cover plate in place and welded to the container shell.

The powder is charged or loaded into an extrusion container 11 which may be a piece of carbon steel pipe 8 having a bottom end 9 of carbon steel welded thereon. Into this container I load the metal powder 10, in level layers of about 2" thickness. Container 11 is thus charged with metal powder 10 in multiple superposed layers 12, as shown in FIG. 1. Each layer 12 after being charged is compacted by a high energy rate forming ram 16, as is shown in FIG. 2, so as to compact the powder to a tap density of about 80% of theoretical. I estimate that the energy level delivered to the metal powder by compacting is about 3,000,000 psi. This procedure is repeated until the container is filled to approximately 4" from the top. Then a carbon steel plate 17 fitting inside container 11 is placed loosely on the powder 10 in container 11 but is not welded or otherwise affixed to container 11. Plate 17 is about 3" thick, and forms an inner cover for the powder. A similar disk, plate 18, is then placed on top of plate 17, and is welded to container 11 around the top edge of the latter, as is shown in FIG. 4. Plate 18 is inset about 1" into container 11, and forms an outercover therefor.

Container 11 so prepared is then placed in a heat treating furnace and is heated to a temperature substantially below the melting point of the alloy for 6 hours or so. For tool steels the heating temperature is from 1400° to about 1900° F. For other alloys, such as high temperature alloys used in aircraft engines, the temperature range may extend to about 2100° F. The heating increases the density of the metal powder 10 to approximately 90–93% of theoretical density.

Figure 5:
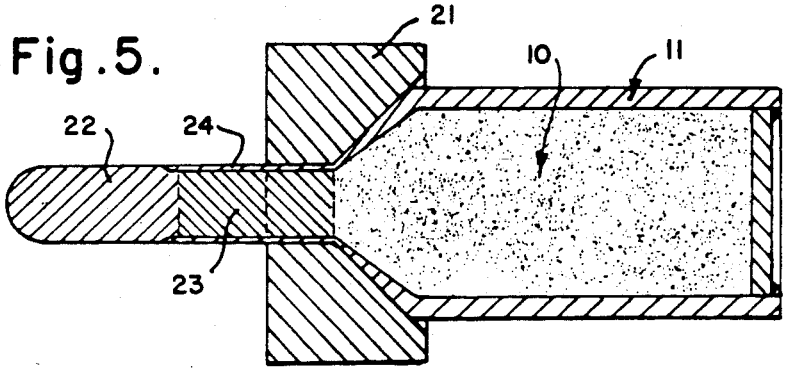
FIG. 5 is a cross-section of the extrusion container of FIG. 4 partly extruded through an extrusion die.

The container 11 is then rapidly transferred from the heat treating furnace to the extrusion press, in about a minute, and extruded at a reduction ratio of about 3 to 1 at approximately 3000 tons pressure. In FIG. 5 extrusion container 11 is shown passing through extrusion die 21. Outer cover 18 is extruded into noise portion 22 of the extrusion and inner plate 17 is extruded into portion 23. As plate 17 is not attached to the wall of container 11, that wall is drawn over plate 17 as thinner wall 24. It is my belief that plate 17 is extruded into portion 23 of greater cross-sectional area than wall portion 24 which is therefore more highly strained than portion 23, and is elongated with respect thereto. Portion 23 in effect has been extruded backwards, further compacting the powder 10 in container 11 to a density of approximately 100% of theoretical.

Figure 6:
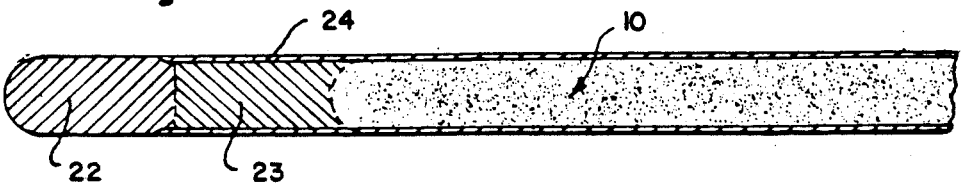
FIG. 6 is a cross-section of the fully extruded container of FIG. 5.

FIG. 6 shows the billet produced when container 11 has been fully extruded.

Because of the added compaction of the powder 10 by the elongation of wall portion 24 occurring while plate 17 passes through the extrusion die, it is possible to obtain a billet the full diameter of the extrusion container with density 100% of theoretical by stopping the extrusion process when plate 17 has passed through the die, and removing the partially extruded container 11 without extruding the remaining portion.

EXAMPLE NO. 1

An M-2 tool steel alloy containing the following nominal constituents: carbon=0.85%, manganese=0.30%, silicon=0.30%, chromium=4.00%, vanadium=2.00%, tungsten=6.00%, molybdenum=5.00% and the balance=iron, was first converted to powder by inert gas atomization using the rapid solidification method.

The resultant metal powder alloy was sieved through a No. 80 mesh, U-S. Standard Sieve. This graded alloy metal powder was then placed into a stainless steel "V"—cone blender, and blended for 30 minutes.

The metal alloy powder was then placed into a 1010 carbon steel pipe with a bottom plate welded into the bottom. The carbon steel pipe measured 12" diameter×38" long. The powder was placed into the container in 2" high increments, after which the high energy rate forming ram was brought into position, and caused to impact several times. This procedure was continued until a full height of 34" was achieved.

The loaded container was weighed and contained approximately 750 lbs. of M-2 alloy metal powder.

The floating or free moving disk was placed into the carbon steel container. The second steel disk was then placed on top of the free moving disk, and welded circumferentially to the carbon steel pipe.

The prepared extrusion shell was placed into a heat-treating furnace, and heated to a temperature of 1700° F., and allowed to soak for a period of six hours at 1700° l F.

The heated extrusion shell was automatically transferred from the heat treating furnace to the extrusion press in 40 seconds. The extrusion container was extruded through a 7.170" diameter die. The resultant extrusion was 7.170" diameter×approximately 7' long.

The extruded product was then placed into a vermiculite bed, and allowed to cool slowly to room temperature.

After cooling, the extrusion head and tail were cut off. The resultant billet was then cogged at 1800° F. from 7.170" diameter down to approximately 6" diameter.

The cogged billet exhibited excellent plastic deformation and elongation, without any cracking or endbursting, with virtually no decarburization, as the metal was protected by the extruded carbon steel pipe which was approximately ⅛" in thickness.

Following the cogging operation, the powder metal billet was then hot-rolled to a finished dimension of about 4" R.C.S. (Round Cornered Square).

There was no decarburization, due to the carbon steel shroud which after rolling measured approximately 1/32" thick.

The resultant product was 100% of theoretical density, and consistently exhibited a grain size finer than #30, as determined by the intercept method. The carbide distribution was extremely fine, and difficult to differentiate between grain size and carbide size.

Finally, the resultant product was subjected to reflectoscope analysis and found to be sound and free of defects.

EXAMPLE NO. 2

Using the procedures described in Example No. 1, a T-15 alloy metal powder, with the following nominal chemical analysis carbon=1.55%; manganese=0.30%; silicon=0.30%; chromium=4.50%; vanadium=5.00%; tungsten—13.00%; molybdenum=0.50% and cobalt=5.00%; the balance iron, was extruded to a 7.170" diameter and subsequently rolled to approximately 3" in diameter, with similar results in regard to density, grain size and soundness.

EXAMPLE NO. 3

Using the procedure described in Example No. 1 and No. 2, a typical M-2 tool steel alloy metal powder was subjected to a partial extrusion whereby just the mechanical device located in front of the extrusion shell was extruded to a pre-determined length sufficient to allow the free moving disk to move to a point sufficient to exert a pressure against the powder to result in approximate 100% density, as described in FIG. 5.

The resultant product from the partial extrusion was subsequently cogged down to an approximately 6" diameter billet by approximately 7' long subsequently hot rolled to a 4" R.C.S. billet, with similar results obtained from the fully extruded and rolled product.

As I have mentioned, I prefer to use carbon steel pipe for my extrusion container. The wall thickness of 12" carbon steel pipe is somewhat grater than ¼" but less than ½". As long as the extrusion container is made from metal having a lower resistance to deformation than the metal of the billet the wall thickness of that container is not critical.

Figure 7:
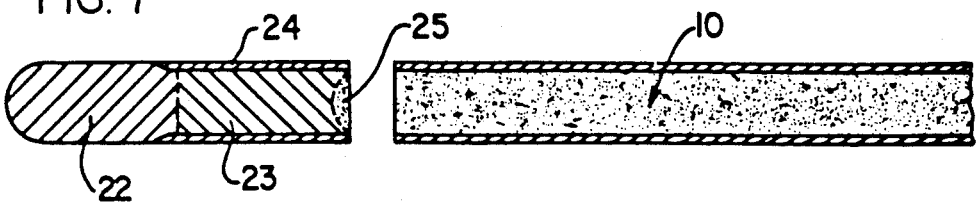
FIG. 7 is a cross-section of a fully extruded billet of FIG. 6 after cropping.

In the foregoing description inner cover 17 is formed from plates having parallel outer surfaces. After extrusion extruded plate 17, now carrying reference character 23, is partially extruded backwards as described, and I have found that the boundary between portions 23 and the compacted powder billet 10 is, in fact, concave toward portion 10, as is shown by the dotted line in FIGS. 6 and 7. In order to obtain a commercially acceptable powder billet 10 the extruded portions 22 and 23 of FIG. 6 must be cropped, as shown in FIG. 7. The volume 25 of consolidated powder billet bounded by the dotted line in FIG. 7 must be included in the crop, with a resulting diminution in yield.

Figure 8:
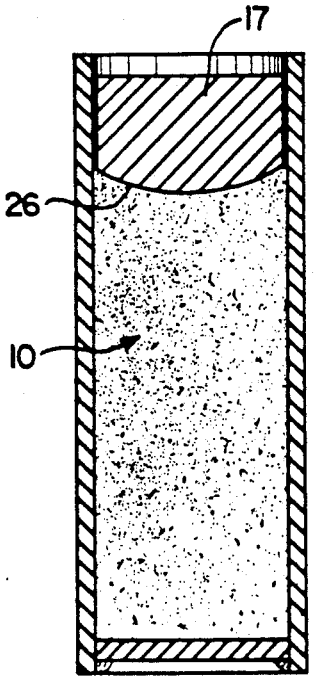
FIG. 8 is similar to FIG. 3 but shows an inner cover shaped differently from that of FIG. 3.
Figure 9:
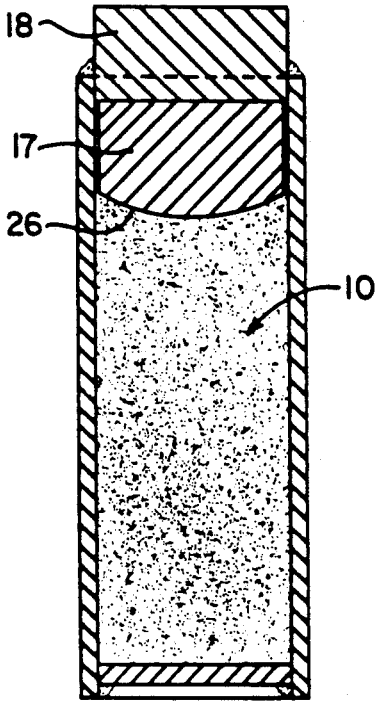
FIG. 9 is similar to FIG. 4 except for the shape of the inner cover.
Figure 10:
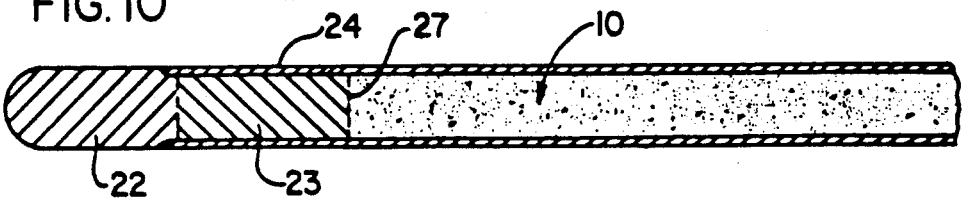
FIG. 10 is similar to FIG. 6 but shows the cross-section of the fully extruded container of FIG. 4.

I overcome that loss of yield by contouring inner cover 17 as shown in FIGS. 8 and 9. Its lower surface 26 is made convex. When the heated container of FIG. 9 is extruded the convex surface 26 of inner cover 17 is flattened, as is shown in FIG. 10, so that the boundary 27 between the body 10 and the extruded cover 23 is substantially planar. Because of this planar junction cropping of the billet at that boundary creates no appreciable loss in yield. I find, in fact, that the bond between inner cover 17 and powder billet 10 at plane surface 27 is relatively weak and that it is not necessary to crop with a cropping shear or similar device. The nose of the billet can usually be detached by hitting it with a sledge, which causes it to break off at the boundary 27.

While I have shown and described a present preferred embodiment of the invention and have illustrated a present preferred method of practicing the same, it is to be distinctly understood that the invention is not limited thereto but may be otherwise variously embodied within the scope of the following claims.

I claim:

1. The method of producing dense billets of metal powder comprising loading the powder into a container formed from a metal having a lower resistance to deformation than the metal of the billet, compacting the powder in the container to a tap density of about 80% of theoretical, covering the powder in the container with an inner plate not attached to the container, covering the inner plate with a cover plate and attaching it to the container, both plates being made of metal having a lower resistance to deformation than the metal of the billet and having thicknesses several times that of the container wall, heating the filled container to a temperature below the melting point of the container and the metal powder, and hot extruding the filled container cover plate first whereby the inner plate is partially extruded against the powder so as to raise the density of the extruded billet to substantially 100% of theoretical.

2. The method of claim 1 in which the container and cover plates are formed of carbon steel and the powder is of an alloy harder than carbon steel.

3. The method of claim 2 in which the container wall is not more than one-half inch thick and the inner and outer covers are about three inches thick.

4. The method of claim 1 in which the metal powder was atomized by an inert gas and cooled from its liquidus temperature to about 425° C. in no more than one-tenth of a second.

5. The method of claim 1 including the step of heating the filled container to a temperature below the melting temperature of the container and the metal powder for about four to six hours, thereby increasing the density of the powder before extrusion to 96% to 97% of theoretical.

6. The method of claim 5 in which the extrusion of the filled container is stopped after the cover plate and inner plate have been extruded, whereby the density of the unextruded portion is raised to substantially 100% of theoretical.

7. The method of claim 1 in which the powder is loaded into the container in a plurality of substantially level layers.

8. The method of claim 7 in which the powder in each layer is compacted in the container with a high energy rate forming ram.

9. The method of claim 1 in which the filled container is hot extruded at a reduction rate of about three to one and a pressure of about 50,000 p.s.i.

10. A billet of extruded metal powder produced by the method of claim 1.

11. A billet of unextruded metal powder produced by the method of claim 6.

12. The method of claim 1 in which the face of the inner plate contiguous to the compacted powder is convex before the heating of the filled container but is substantially planar after the hot extruding of the filled container.

13. A billet of extruded metal powder produced by the method of claim 12.

* * * * *

UNITED STATES PATENT AND TRADEMARK OFFICE

CERTIFICATE OF CORRECTION

PATENT NO. : 4,632,702

DATED : December 30, 1986

INVENTOR(S) : VINCENT N. DIGIAMBATTISTA

It is certified that error appears in the above-identified patent and that said Letters Patent is hereby corrected as shown below:

Column 4, line 2, delete "l" before F.

Signed and Sealed this

Twenty-fourth Day of March, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,632,702

DATED : December 30, 1986

INVENTOR(S) : Vincent N. DiGiambattista

It is certified that error appears in the above-identified patent and that said Letters Patent is hereby corrected as shown below:

Column 3, line 18, "noise" should read --nose--.

Column 6, Claim 5, line 18, "96% to 97%" should read --90% to 93%--.

Signed and Sealed this

Eighteenth Day of August, 1987

*Attest:*

DONALD J. QUIGG

*Attesting Officer*

*Commissioner of Patents and Trademarks*